United States Patent [19]

Krappitz et al.

[11] Patent Number: 4,743,335

[45] Date of Patent: May 10, 1988

[54] DEVICE FOR THE CONTINUOUS FEEDING OF A RIBBON SHAPED MATERIAL TO A PROCESSING MACHINE

[75] Inventors: Heinz Krappitz, Reinbek; Heinrich Krodel, Bayreuth; Johannes Wolfrum, Himmelkron; Rainer Sittkus, Wielenbach; Rolf Becker, Neukeferloh, all of Fed. Rep. of Germany

[73] Assignee: B.A.T. Cigarettenfabriken GmbH, Fed. Rep. of Germany

[21] Appl. No.: 903,956

[22] Filed: Sep. 4, 1986

[30] Foreign Application Priority Data

Sep. 5, 1985 [DE] Fed. Rep. of Germany ..... 3531731

[51] Int. Cl.[4] ..... B32B 31/18

[52] U.S. Cl. ..... 156/502; 156/506; 242/56 B; 242/58.1; 242/58.5

[58] Field of Search ..... 156/502, 505, 506; 242/56 B, 56.9, 58.1, 58.5

[56] References Cited

U.S. PATENT DOCUMENTS

| | | | |
|---|---|---|---|
| 4,543,152 | 9/1985 | Nozaka | 156/502 |
| 4,636,276 | 1/1985 | Nozaka | 156/506 |
| 4,646,986 | 3/1987 | Heitmann | 242/58.1 |

FOREIGN PATENT DOCUMENTS

| | | | |
|---|---|---|---|
| 3125553 | 1/1983 | Fed. Rep. of Germany | 242/56 B |
| 2154217 | 9/1985 | United Kingdom | 242/58.1 |

*Primary Examiner*—Caleb Weston

*Attorney, Agent, or Firm*—Harness, Dickey & Pierce

[57] ABSTRACT

Device for continuous feeding of a ribbon shaped material to a processing machine, complete with a swingable bobbin-carrier, mounted on bearings to a base frame, with at least 2 spindles for the reception of each bobbin.

16 Claims, 12 Drawing Sheets

DEVICE FOR THE CONTINUOUS FEEDING OF A RIBBON SHAPED MATERIAL TO A PROCESSING MACHINE

This invention relates to a device for continuously feeding ribbon shaped material to a processing machine.

This type of device will be employed for example in feeding packaging material to packaging machines, specifically for feeding ribbon shaped material to processing machines in the tobacco industry. So that these processing machines may operate as uninterrupted as possible, a continuational bobbin will be prepared for the processing, during the course of the ribbon from one of the bobbins to the other supply roll.

A device of the above-mentioned sort, which should make an automatic bobbin exchange possible, is recognized, for example in DE-No. 05 34 41 205. With such a device, the cutting devices knife consists of a laminated spring, perpendicularly situated to a wedge-shaped cutting edge. The knife is pressed (by means of a conducting cylinder parallel to the bobbin axle between the outer edges of the bobbin), whereby one or more sheets of ribbon are easily lifted and separated.

A pincer tongs that is connected to a conveyor belt will seize the segment of the separated layer or layers. With the help of this conveyor belt, the seized ribbon segment (which is held in the pincer tongs) is pulled over to the area of the glue station where the beginning of the ribbon on the new bobbin should be connected with the end of the ribbon on the bobbin which has run out.

When using this established device for the processing of thin ribbon-shaped materials, (for example, cigarette paper,) it is hard for the cutting device to reliably only cut the outermost layer of material. Normally, the knife of the cutting device will seize and separate a number of ribbon coils. Aside from the loss of material, this device has another disadvantage: it is difficult now to safely remove the paper strips which originate from the separated ribbon coils from the ribbons transport path. The transport device, which is necessary in transporting the beginning of the ribbon to the glue station, is relatively involved and voluminous.

According to the present invention, the device doesn't force the knife, (as does the established device) between the outermost ribbon layers. Instead, the opening element, which operates as a splaying finger, slides on the circumference of the new bobbin, until it travels under the free ribbon end of the bobbin. In this way the opening element withdraws the first ribbon segment from the underlying coil. If the finger together with the knife was shifted into a position parallel to the bobbin axle, it would insure that only the uppermost layer of ribbon would be separated. Aside from this advantage, the solution in accordance with the invention insures that only the ribbon or bobbins that are situated in the correct orientation on the spindle will be cut. However, with the established device a new bobbin will be cut, regardless if the bobbin is correctly positioned in relation to the direction of the ribbon's flow, or if it has been incorrectly placed on the spindle. With the established device, the mistake will only first be noticed, when the transport device has merely pulled cut off paper strips with the pincer. However, with the arrangement of this invention, the cutting device cannot cut into the bobbin, if the bobbin has not been positioned in the proper orientation on the spindle.

After the ribbons which are to be glued to each other are brought into congruence, before the one bobbin is completely unrolled, the end piece of the unrolled ribbon can be glued to the beginning piece of the new ribbon, at a point in time which is conveyed by means of a sensor suitable for this task. The empty bobbin case of the unrolled bobbin can be removed from the spindle, and a new bobbin can be set in its place.

In order to not disturb the ribbon flow during the turning of the bobbin carrier, and to insure that the new bobbin can swing into place in the still flowing ribbon without problem, it is advisable that a ribbon stretch roll be harnessed radially on the outside of each spindle on the bobbin holder, which lies in the direction of flow of the ribbon, looking behind the ribbon holding device, which is attached to each spindle.

The free end piece of the unrolling bobbin cannot usually be worked in, because it is disfigured through the glue strip, and also because the outermost unrolling ribbon coil now still is captured in the form of a short ribbon piece over the glue strip on the ribbon beginning. Preferably the bobbin cutting off station is comprised of a delivery device to deliver the free ribbon end to a second outlet device, and a cutting equipment to cut off the ribbon segment which is drawn off from the second outlet device. In this way, the damaged and unworkable beginning segment of the ribbon on the continuing bobbin will be drawn and cut off, so that the following material on the new ribbon beginning will be faultless. Then the condition of the material can be checked over by a sensor suitable for this purpose.

The seizure of the ribbon end by means of a ribbon stopping device can be facilitated, if the cutting equipment has an adjustable second knife, relative to the carrier axle in at least approximate radius. This adjustable second knife will interact with an opposing knife, which is permanently supported and situated in the area of the ribbon stopping equipment. At least for nonpourous material, the ribbon stopping equipment can also be fashioned like the earlier mentioned catching device, from a suitable absorbent strip.

The delivery device, which should deliver the segment of ribbon which is held tight by the catching device, to the second pulling off device, can just as well be fashioned from an absorbing element, which is connected to a pivotable swinging arm mounted on bearings to an underlying frame. And in this way, between an accepting position and a delivery position, (away from the carrier axle) it can be adjusted closer to the pull off equipment. The absorbing element is thereby suitably developed in the form of an absorbent roll or cylinder which is mounted on bearings around one of the axles on the swinging arm, parallel to the carrier axle. Thus, the delivery of the ribbon segment from the catching device to the absorbent roll may take place in a simple way, that the cutting off device and the catching device are arranged on a swingable rocker arm mounted on bearings around the cylinder's axle. By adjusting the rocker arm around the cylinder axle, the ribbon segment (which is being held fast in the catching device) will be laid around the absorbing roll, so that the ribbon segment can be reliably held fast to the absorbent roll while the delivery device is swung into its delivery position on the second pulling off equipment. The second pulling off device turns to a suitable disposal device, for example, a material shredder, for the unusable separated segments of ribbon.

The gluing together of the ribbon end of the unrolling ribbon to the ribbon beginning of the next ribbon coil to be unrolled can result independently of material in different ways, for example, in the way already established, by means of a glue ribbon. In addition, the glue station has a glue ribbon supply, an adjustable glue ribbon transport and stamping element, (which are relative to the radius of the carrier axle) and a third knife to cut through the ribbon segments which lay over one another and are to be bound together. This third knife operates in conjunction with the opposition knife, which is situated in the area of the ribbon stopping equipment. This arrangement makes it possible, to glue both ribbons end on end together, so that the glued places between consecutive ribbons are practically unnoticeable. Above all, it is necessary, in addition, that the pulling off mechanism has a ribbon reservoir, and that a ribbon brake is situated in its downward direction of flow, which is capable of alternating. As the end of the ribbon from the unrolling coil gets closer, the ribbon reservoir will be filled. This makes it possible, during the gluing process to stop the unrolling ribbon, whereby during this time, the processing machine is being supplied by the ribbon reservoir. After the unrolling ribbon stops in the glue station, the segments of ribbon which lay on top of each other will be cut. The segment of the unrolling ribbon nearest the spindle must be pulled away, which will, for example, be carried out by the tension reel, which is connected to every spindle, over which the ribbon segment, (which extends from the bobbin to the pulling off mechanism) is led. Thus, the ribbon segments which are to be connected to each other are freely lying end on end, so that they may easily be connected by a glue strip. This makes it also possible, to even put ribbons with a pattern or design on them into the correct rapport together, under operation of a probe device suited for this purpose.

Further characteristics and advantages of the invention are provided in the following description which, are clarified by the accompanying drawings depicting a design example.

Figure 1:
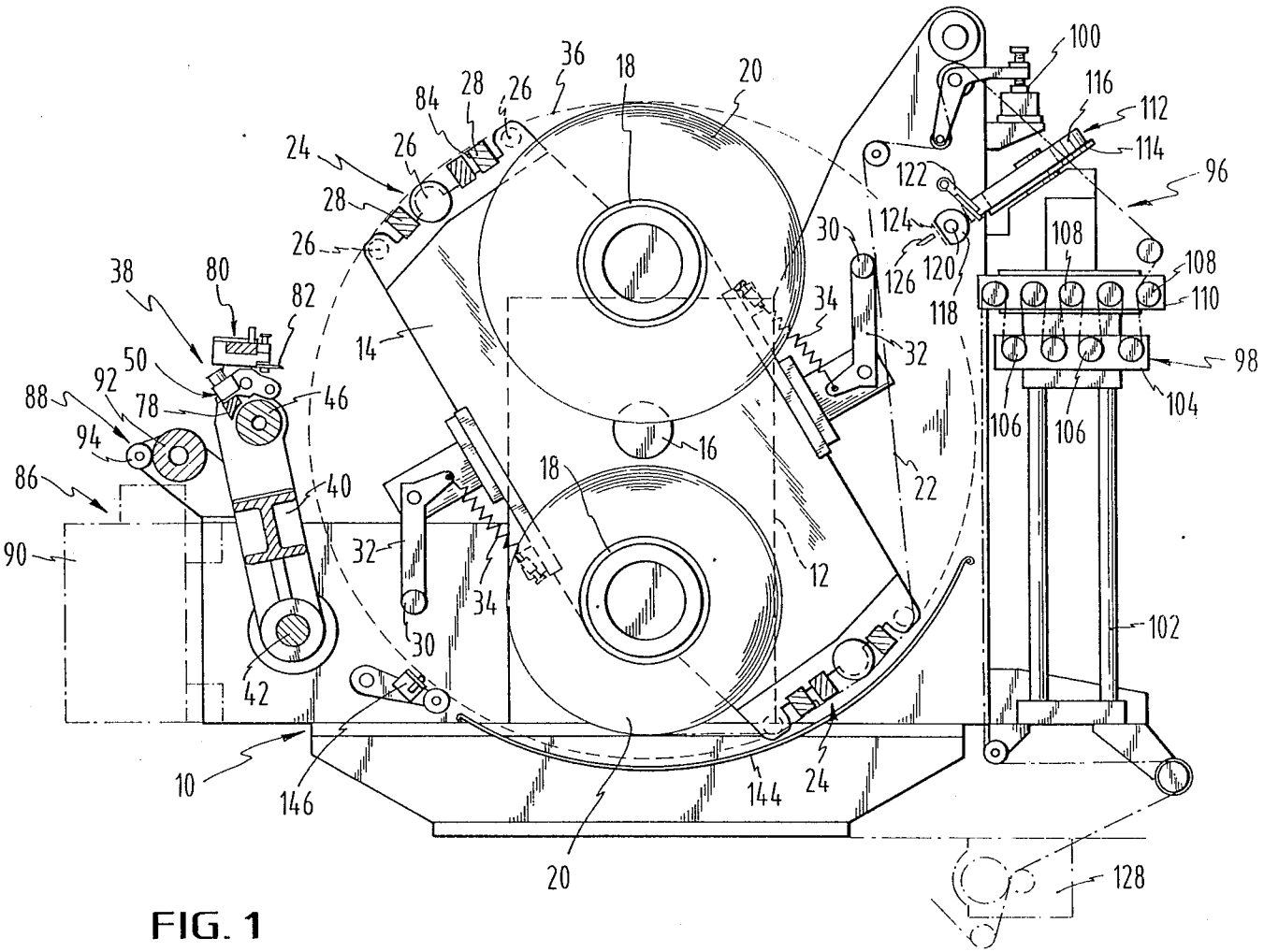
FIG. 1 is a schematic general representation of the device in accordance to the invention.
Figure 2:
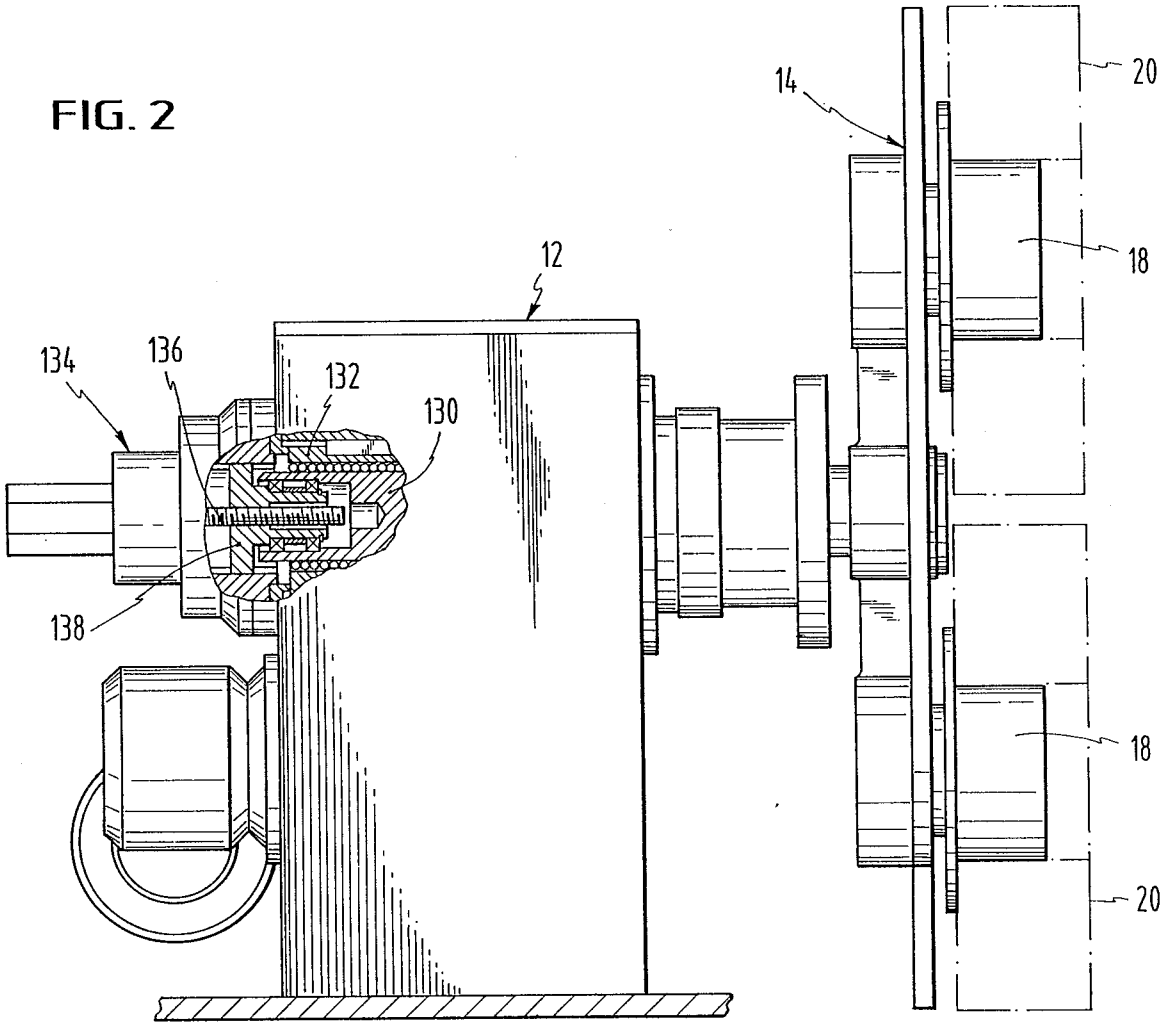
FIG. 2 is a side view of the bearing and propulsion unit for the bobbin carrier.

In FIGS. 1 & 2, one recognizes a base frame, generally referred to here as 10, with a supply - and drive unit 12, on which a bobbin carrier 14 is situated, which is mounted on bearings so as to enable it to swivel around the carrier axle 16. The bobbin carrier 14, may be brought into different angle positions by means of the drive unit 12. There are two spindles 18 situated on the bobbin carrier 14, laying diametrically opposed to each other, both at the same distance from the carrier axle 16. These spindles 18 are rotatable and drivable, whereby the spindle axles are adjusted parallel to the carrier axle 16. Bobbins 20 are affixed on the spindles 18, from which a material band 22 should be pulled and fed into a processing machine. (The processing machine is not represented in the drawings.)

A ribbon feeding and stopping device, generally referred to here as 24 is situated near each spindle 18, on each horizontal end of the bobbin carrier 14, for the material band 22.

This ribbon feeding and stopping device includes feeding rolls 26 as well as absorbent strips 28, whose function will be more fully explained later (with aid of) FIG. 7–13.

At the same time, a pivoting arm 32 is rotatable and mounted on bearings to the horizontal sides of the bobbin carrier 14. This pivoting arm 32 carries a tension reel 30 and is harnessed radially on the outside by means of a spring 34. Exactly as with the spindle 18, the ribbon feeding and stopping device 24 (as well as the pivotal arm 32 in regards to the carrier axle 16) are arranged in a position lying diametrically opposed to each other, so that the material band 22 may run off both bobbins under the same conditions. The bobbin carrier 14, could also be designed for more than two bobbins. In this case, the additional spindles 18 would each be fitted with a ribbon feeding and stopping device as well as an additional tension reel 30. The arrangement according to the representation in FIG. 1 is so drawn, that the outer pivotal circle 36 of the bobbin carrier 14 is determined by the extension of the feed ribbon from the ribbon feeding and stopping device 24.

In the representation of FIG. 1, a cut off station 38 is found on the left of the bobbin carrier 14. In the cut off station 38, the bobbins to be glued together next should be here cut off and prepared, so that the ribbon beginning of a new bobbin can be connected with the ribbon end of the material band 22 which is presently unrolling. This guarantees a continuous ribbon supply to the processing machine. A more detailed explanation of the cut off station 38 will be provided in the schematic representation in FIG. 1 and in the corresponding detailed representations in the FIG. 3–6.

The main parts of the cut off station 38 are arranged on a pivotal arm 40, which is pivotable around the axle 42 and is mounted on bearings to the base frame 10. In the upper segment of the swivel arm 40, a turnable and propelable absorbent roll 46 is mounted on bearings in a frame 44, that extends essentially parallel to the swivel arm 42. By means of a suitable ventilation, a vacuum can be constructed through the roll axle 48 on the absorbent roll 46.

The actual cut off device 50 is situated on a pivotal framework 52, which is pivotable around the axle of the absorbent roll 46. The pivotal arm 52 consists of 2 pivotal arms 54 which pivot around the roll shaft 48. These 2 pivotal arms 54 are connected through a feeding rod 56 and a coil spindle which is parallel to the feeding rod 56.

A sliding carriage 60, (adjustable parallel to the axle of the absorbent roll 46) is led on to the feeding rod 56. The sliding carriage 60 is propelable through the coil spindle 58. A splay finger 62 is screwed onto the sliding carriage 60. The splay finger 62 is tilted at a slight alpha axis with its horizontal axis across the bobbin's axle. The splay finger 62 has an air foil at least approximately in the area of its free end (see FIG. 5), whereby it's horizontal edge 64 (fixed in arrangement on the bobbin's circumference) constitutes the narrow air foil section. A flat channel 66 is found near the free end of the splay finger 62, on the plane which faces the bobbin 20. This flat channel 66 guarantees (together with the insignificant tilt of the splay finger 62 across the bobbin axle), that the splay finger 62 lays on the bobbin circumference only with it's free independent end.

A disc-shaped rotary knife 68 is also mounted by bearings on the sliding carriage. The rotary knife's 68 cutting planes are arranged essentially parallel to the upper edge 64 of the splay finger 62, and their outer circumference (in view of the rotary knifes' rotational axis) projects to the air foil section of the splay finger 62 (see FIG. 4). Thereby, the edge of the splay finger 62 which faces the rotary knife 68, can also be developed as an oppositional cutting edge. The rotary knife 68 is connected to a propulsion roll 70, and is propelled by means of a belt 72, which is driven further over (on the arms 54 and on the sliding carriage 60) rolls 74 & 76 mounted on bearings. The propulsion for the belt 72 as well as the propulsion for the coil spindle 58, are installed (in a way not represented here) in one of the arms 64. An absorbent roll 78 (FIGS. 1 & 3) which is fastened on the swivel frame 52, extends parallel to the feeding rod 56 and to the coil spindle 58. The function of this absorbent roll 78, will be later described in more detail.

Another cutting device 80 with an impact knife 82 is situated near the independent end of the pivotal arm 40 of the cut off station 38 on the frame 44. This cutting device 80 is designed to work in conjunction with the oppositional knife 84 on one of the absorbent rolls 28 of the ribbon feeding and halting device 24, in order to be able to cut through the flow of material 22 which runs over it.

To the left of the cutting off station 38 in FIG. 1, there is a disposal station 86 with a reducing mechanism 88 and a material shredder 90. The reducing mechanism 88 includes an absorbent roll 92 (which is situated parallel to the absorbent roll 46) and a propulsion caster 94. The function of the disposal station 86, will likewise be further explained at a later point.

A pull off device (here, generally referred to as 96) with a ribbon reservoir 98 is situated to the right of the bobbin carrier 14 in FIG. 1. In the pull off device 96, the material ribbon 22 will be fed over various feeding and tension rolls as well as over a supervising device 100. This supervising device 100 will deliver a signal if the material ribbon 22 should taper off or rip as a result of a slackening of the ribbon tension, and can for example, cause a stop or check of the processing machine.

Figure 12:
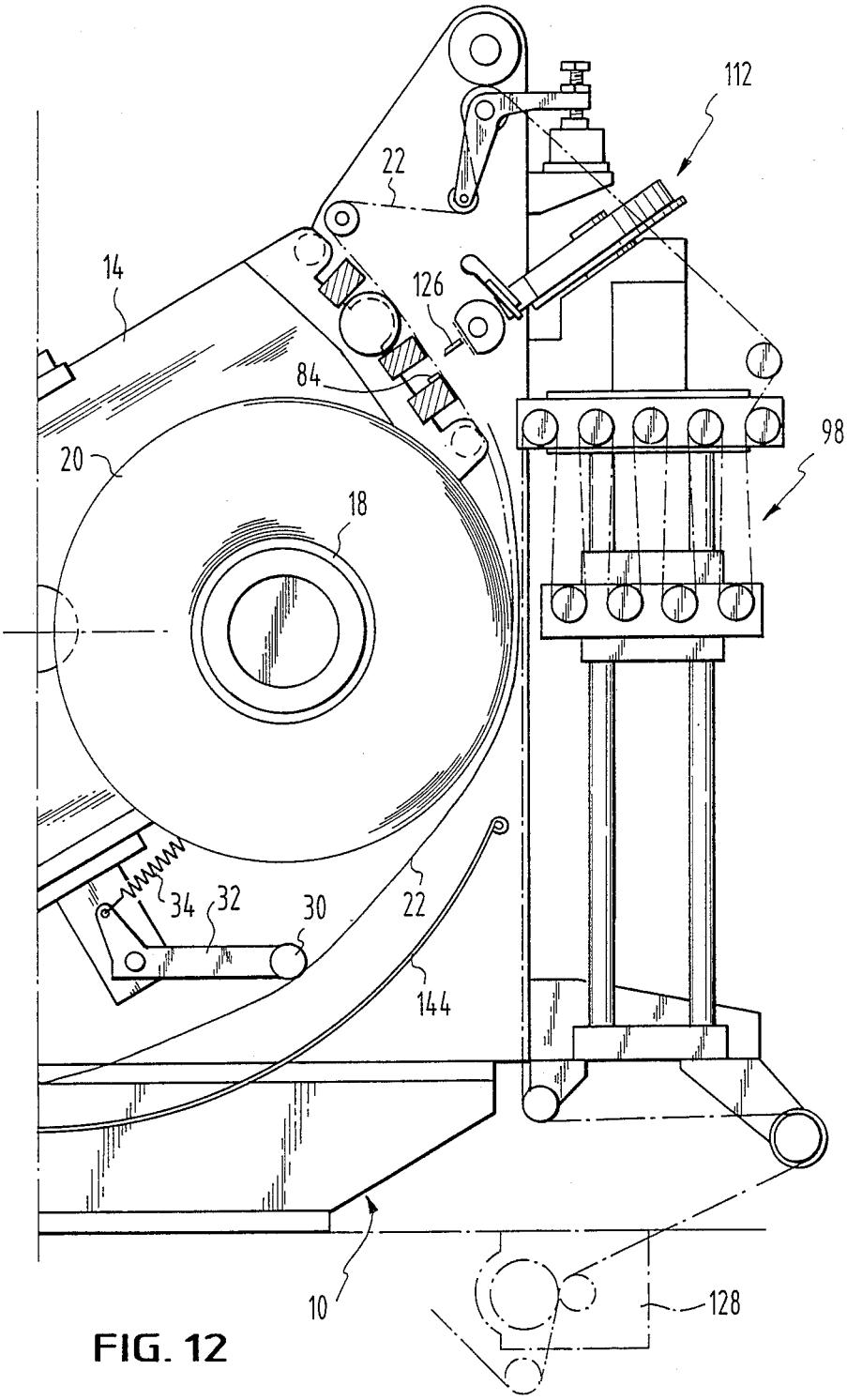
Figure 13:
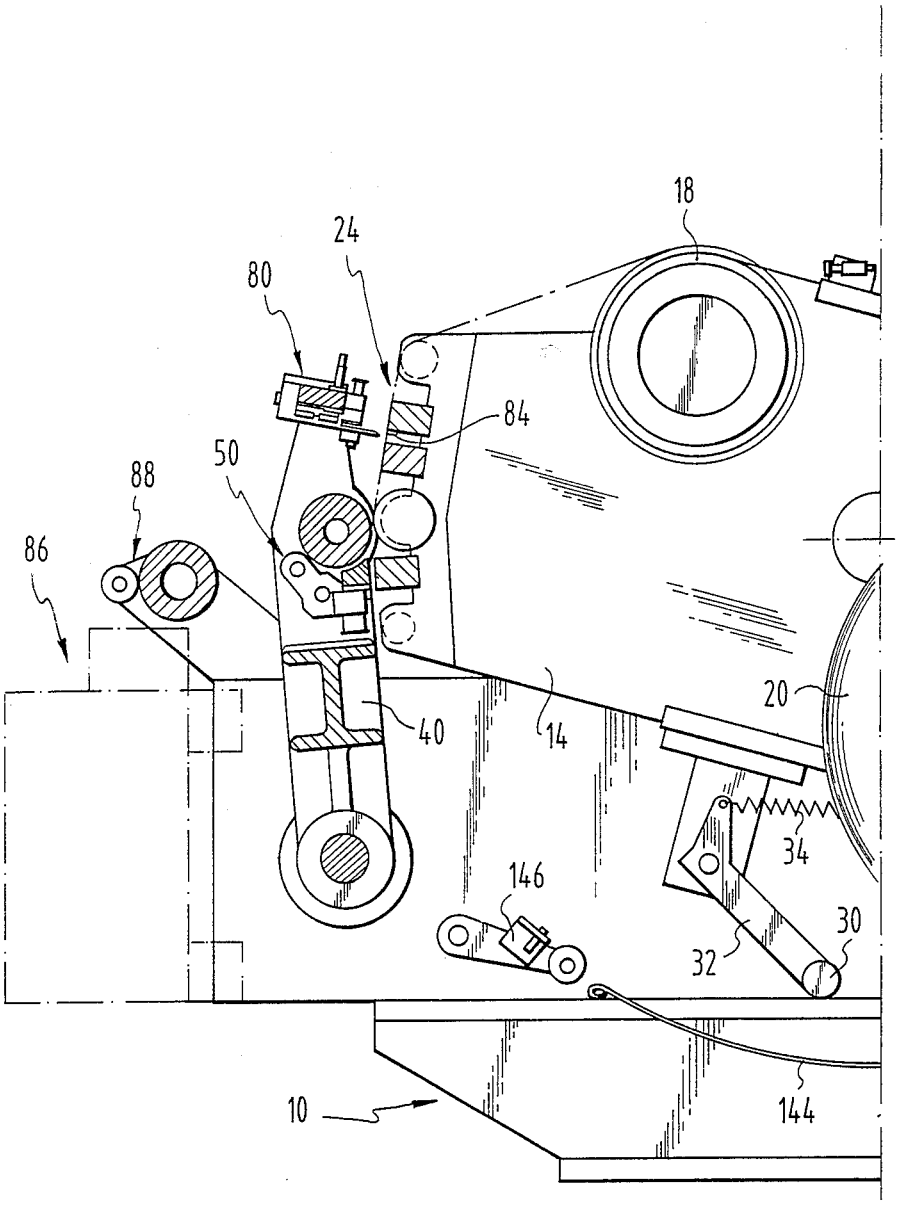

The ribbon reservoir includes a sliding carriage 104 (which is vertically shiftable on a feeding rod 102) with feeding rolls 106. Each feeding roll 106 lies between the feeding rolls 108, which are mounted on bearings to a stationary carrier 110 of the ribbon reservoir 98. Further, if the sliding carriage 104 where to be vertically shifted downwards from it's position represented in FIG. 1, then ribbon loops would form between the rolls 106 & 108, as depicted in FIG. 12. These ribbon loops represent a ribbon supply for the processing machine, in case of the incident when, during a certain operation, the material ribbon must be stopped upstream of the ribbon reservoir 98.

A glue station (here generally referred to as 112) is located over the ribbon reservoir 98 in the schematic illustration. The glue station 112 includes a winch 114 for the glue ribbon roll 116 and a glue head 118. The glue head 118 is capable of swiveling around the axle 120 between the glue position (represented in FIG. 1) and around a 180 degrees intake position, in which it (with the help of a cutting device 122) receives cut off glue ribbon strips 124 from the glue ribbon roll 116.

The glue station 112 also includes a cutting device only schematically indicated through an impact knife 126, which, as will later be explained in detail, can cut off the ribbon band ends which are to be glued together, in such a way that these ends lie end on end.

Downwards from the directional flow of the ribbon reservoir 98, is a sensor device 128, which scans the condition of the ribbon edges, in order to guarantee an even arrival of the material ribbon to the processing machine. If the ribbon edges deviate from the necessary position, the bobbin carrier 14 will adjust to the axial direction. Additionally, in accordance with FIG. 2, the shaft 130 of the bobbin carrier 14 is axially shiftable and mounted on bearings in a bearing casing 132. The shaft 130 can (by means of an adjustable propeller 134, which is only schematically represented) be axially adjusted. This adjustable propeller 134 operates over an adjustable spindle 136, and an press piece 138 which is driven in an axially shiftable way on the carrier shaft 130.

Figure 3:
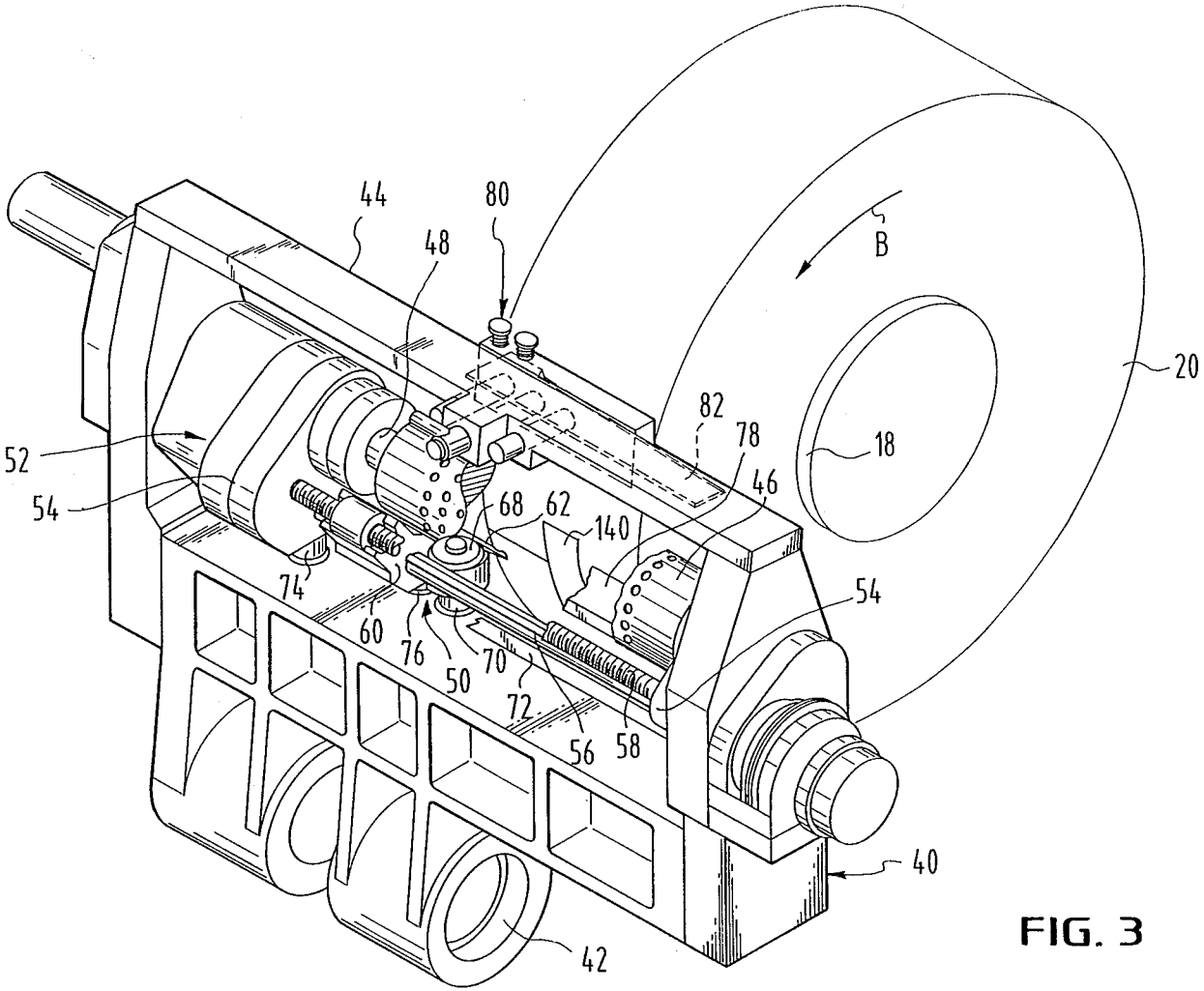
FIG. 3 is a partially cross-sectional perspective partially representing the cut-off station.
Figures 4, 5:
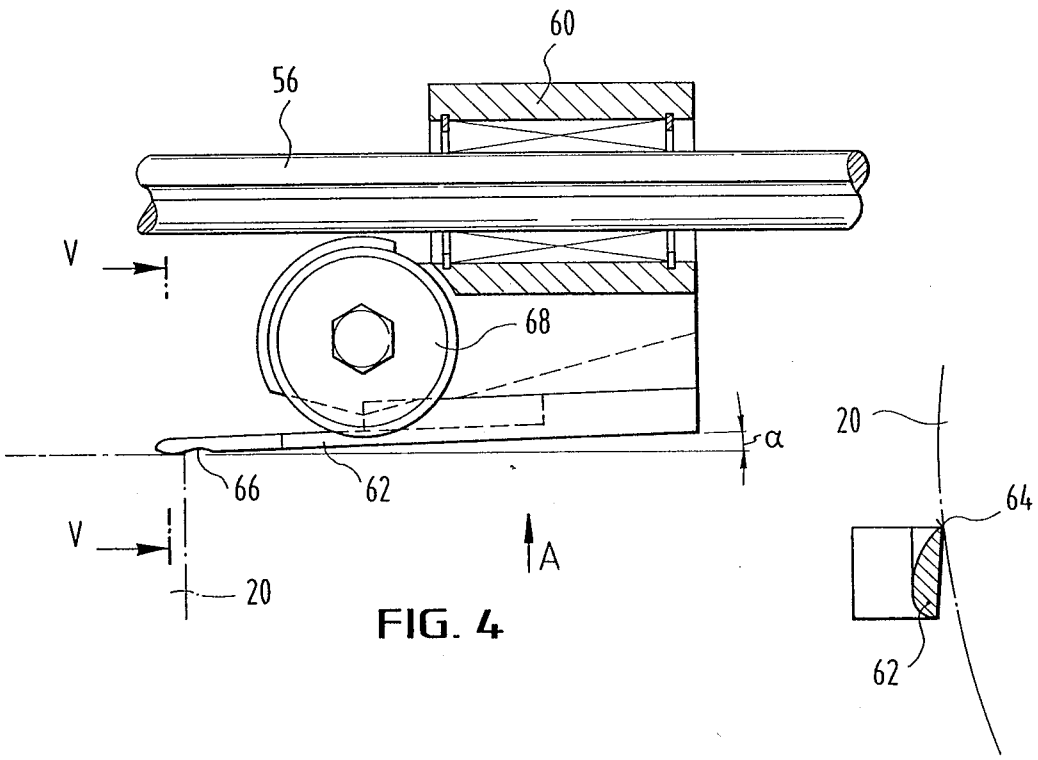
FIG. 4 is a overview of the cutoff mechanisms.
FIG. 5 is a cross sectional view taken along a horizontal line from V—V in FIG. 4.
Figure 6:
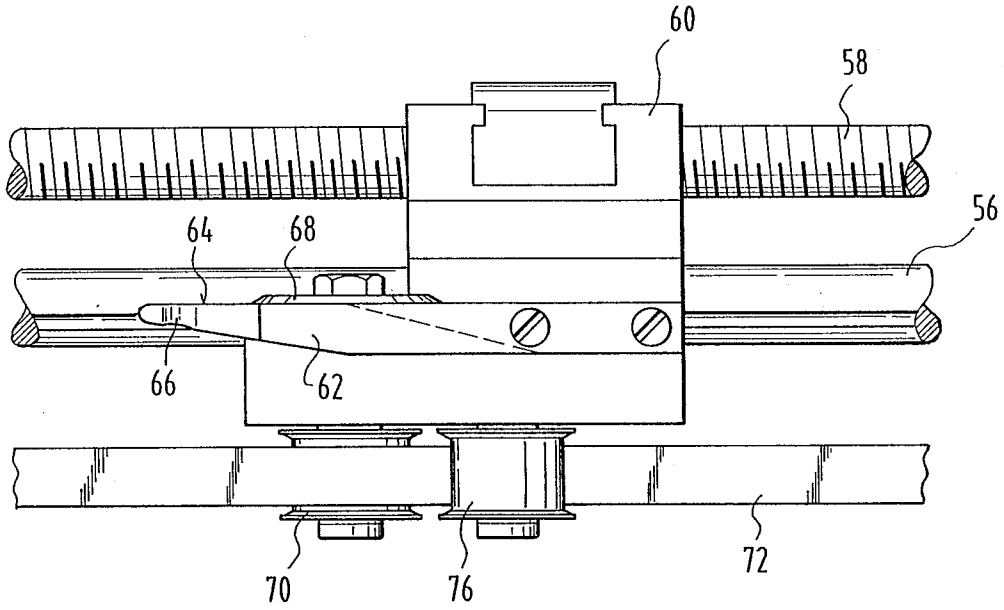
FIG. 6 is a view of the cut off mechanism in the direction of the arrow 4 in FIG. 4.

The device, as it has until now been described, operates as follows:

According to the arrangement in FIG. 1, the material ribbon 22 runs off the lower bobbin 20. In the bobbin carrier 14 position which is represented in FIG. 1, the upper not yet cut bobbins are affixed on the upper spindle 18 for example by means of a robot. In this state, the independent free ribbon end is stuck fast on the bobbin circumference by a glue strip 140, as depicted in FIG. 3.

Figure 7:
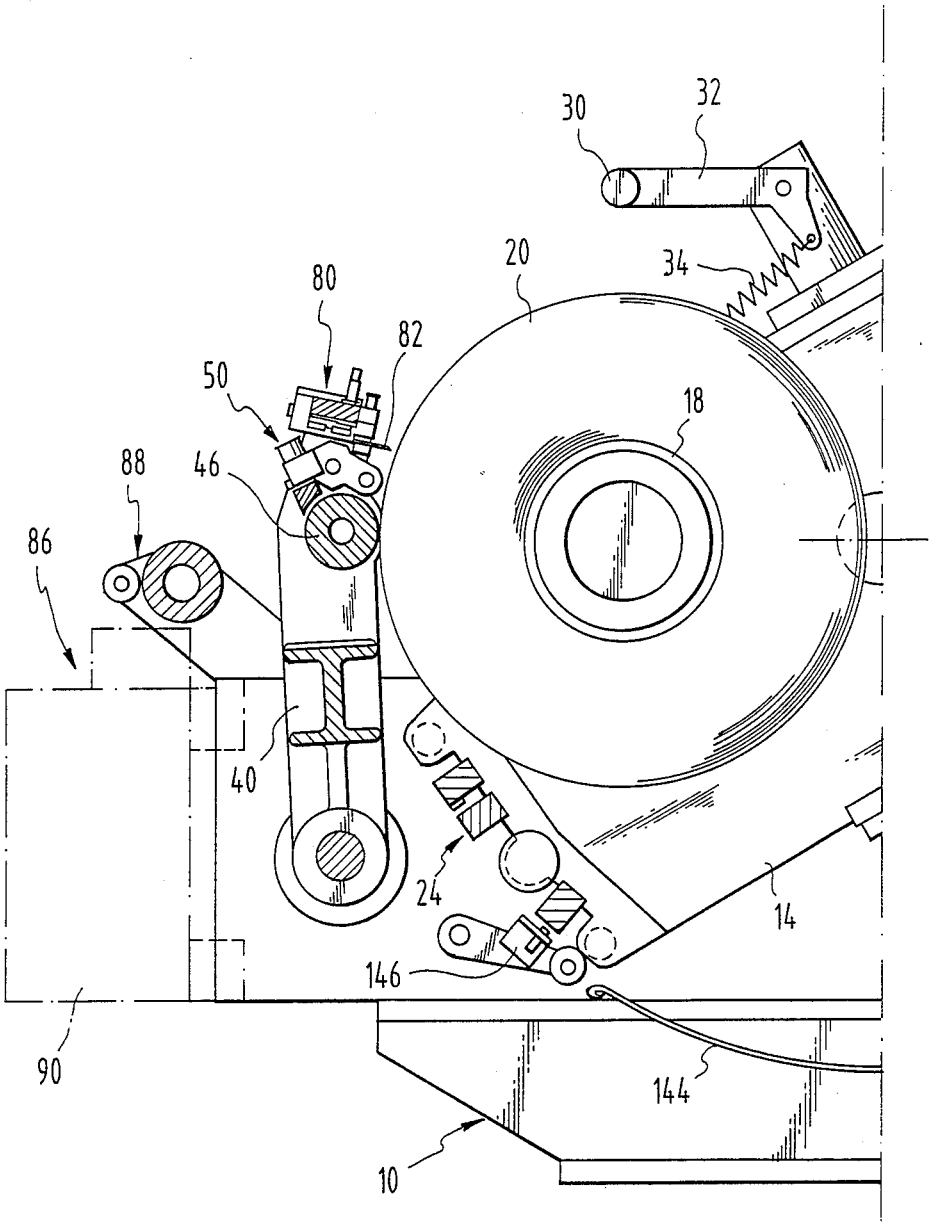
FIGS. 7–13 illustrate the device of FIG. 1 during different stages of operation.
Figure 8:
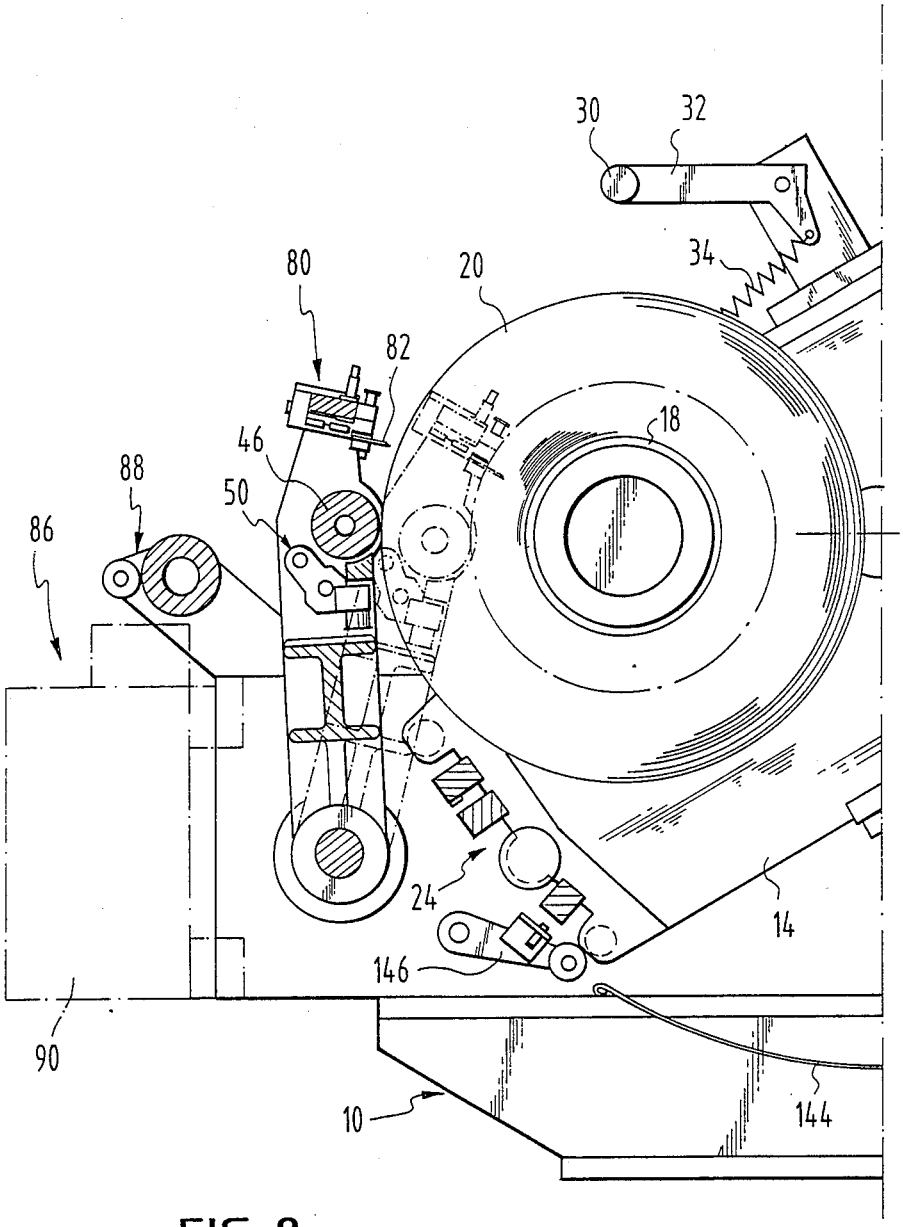
Figure 9:
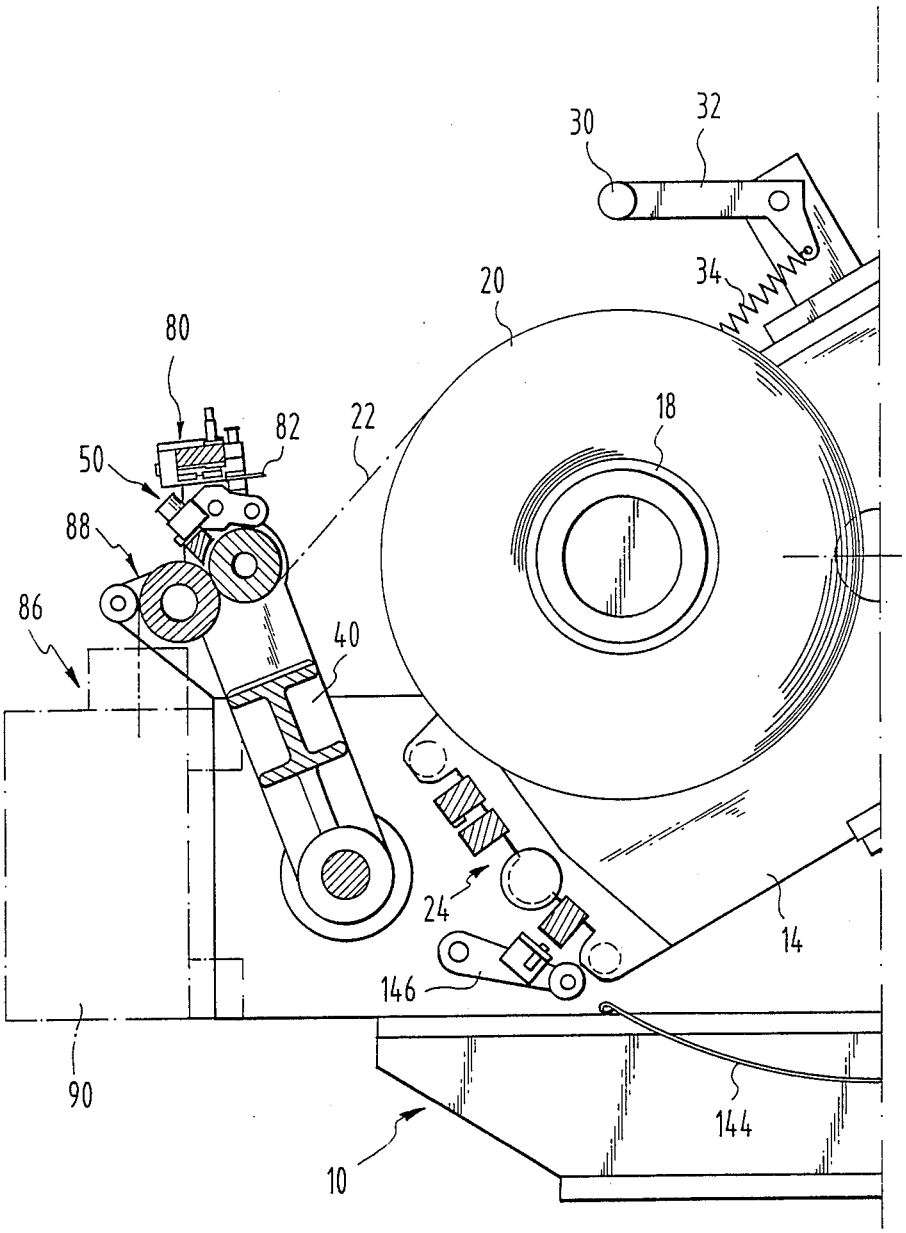

Subsequently the bobbin carrier 14 will be brought from the position represented in FIG. 1 into the position represented in FIG. 7 by means of it's propeller device, in a counter clockwise direction. In this position (according to FIG. 7), the axles of both spindles lie at the same height as each other. The flow of the material ribbon 22 will not be influenced by the pivotal motion of the bobbin carrier 14. Subsequently, the pivoting arm 40, will swing (in a clockwise motion) from it's idle position depicted in FIG. 1 to the position represented in FIG. 7, in which the absorbent shaft 46 lays around the circumference of the not yet cut bobbin 20. Now, the pivotal frame 52 will swing out of it's resting position represented in FIGS. 1 & 7 into its working position, shown in FIG. 8. In this working position, the absorbent roll 78 and the splay finger 62 of the cut off device 50 lay on the circumference of the bobbin 20. FIG. 8 shows that the position of the pivotal arm 40 adjusts to each bobbin's diameter. The position of the cut off device 50 along the feeding rod 56 is so chosen, so that the splay finger 62 (lateral to the glue strip 140) lays on the circumference of the bobbin 20. If this is just turned in a counter clockwise direction (see arrow B in FIG. 3), the splay finger 62 with it's edge 64, slides under the free ribbon end. It can be tested (with help of a suitable sensor device, which is not represented in any of the figures) if the splay finger has reached under the free ribbon end or not, after a full turn of the bobbin. If it has not reached under the free ribbon end, the sensory device responds, for then there is the possibility that the bobbin has been improperly set on the spindle.

If the splay finger 62 is shoved between two ribbon layers, then the sliding carriage 60 will be shifted parallel to the spindle axle by means of the coil spindle 58. Subsequently, the rotating knife will be propelled over the belt 72. By this action, the outermost ribbon layer from the bobbin 20 will be cut open.

Figure 10:
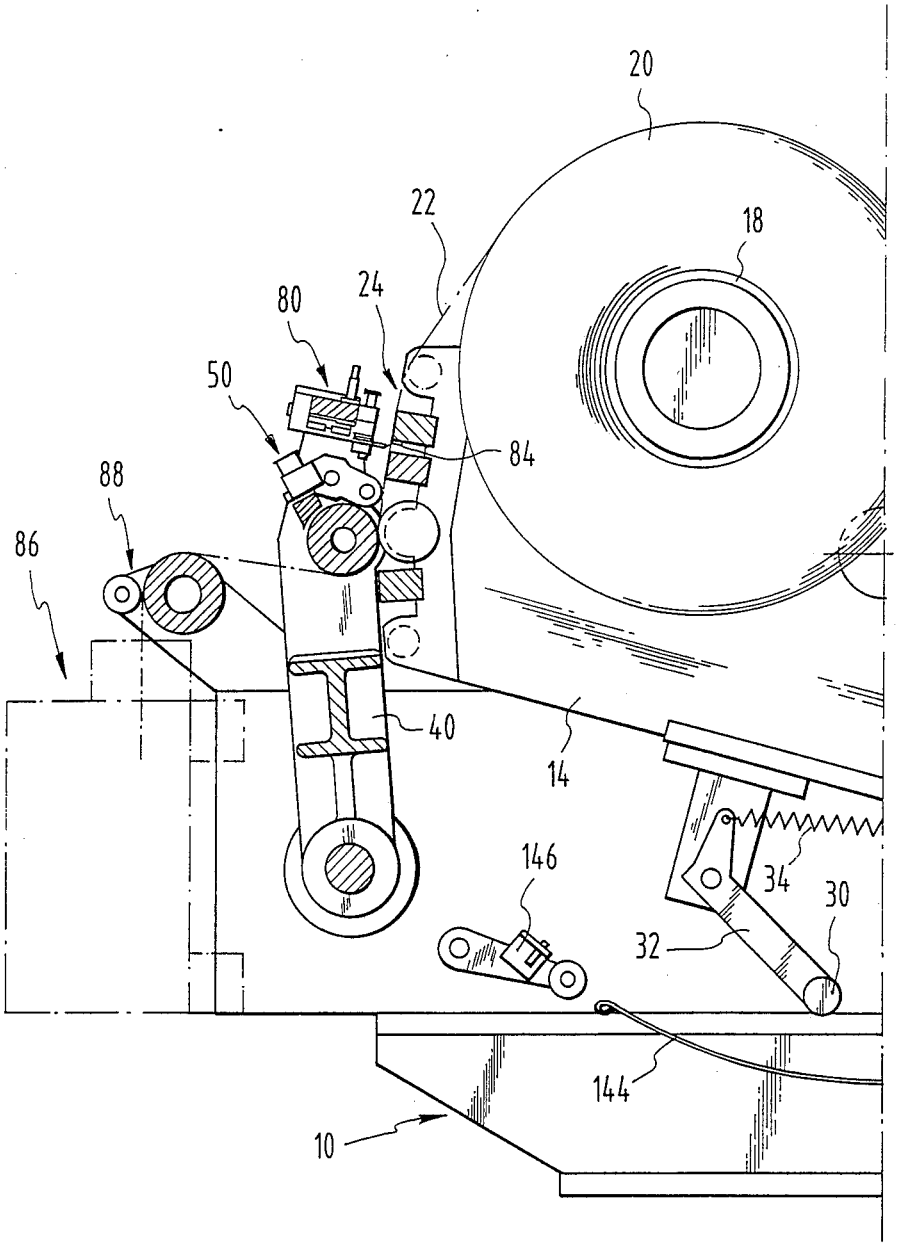
Figure 11:
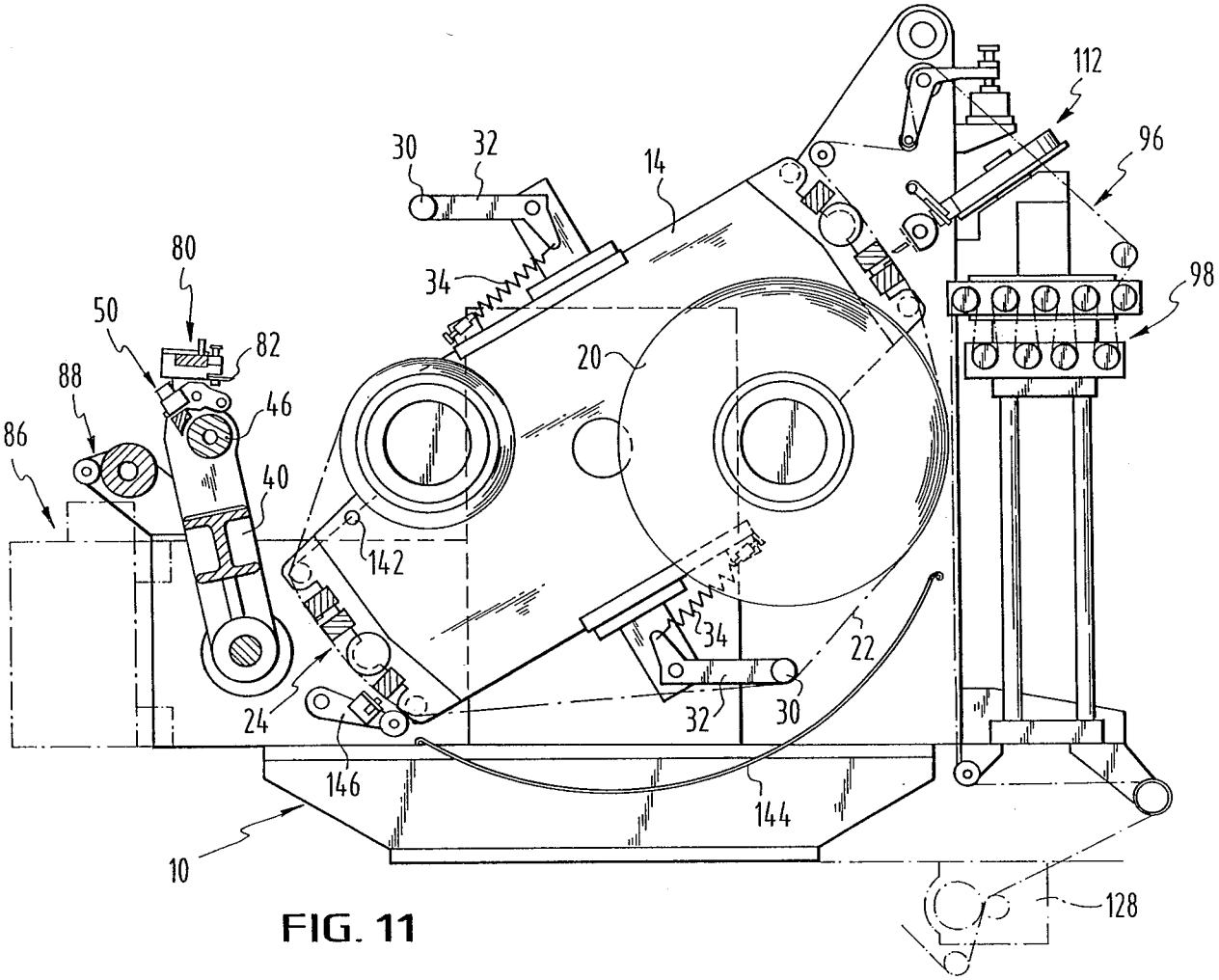

The absorbent roll 78 (which lies over the cut) holds the now free ribbon end fast, and slings it into the position (represented in FIG. 7) around the absorbent shaft 46, as the pivotal frame 52 swings back. The absorbent shaft 46, subsequently holds the ribbon end securely. Then, the pivotal arm 40 swings from the position represented in FIG. 7 to the position depicted in FIG. 9 and transfers the ribbon end to the absorbent shaft 92 of the pulling off device 88, which pulls off at least one ribbon segment (that is still encircled by a glue strip 140) and feeds it into the material shredder 90. The pivotal arm 40 subsequently returns to the position shown in FIG. 10. At the same time, the bobbin carrier 14 is swung (in a clockwise direction) out of the position (shown in FIG. 9) to the position represented in FIG. 10, in which one of the absorbent rolls 28 of the ribbon feeding and holding device 24 of the cutting mechanism 80 lays across from the pivotal arm 40. Then, in co-operation with the opposing knife 84 (situated on the absorbent roll 28), the impact knife 82 cuts off the ribbon segment that was held by the pulling off device 88. This complete ribbon segment is then led to the material shredder 90. The remaining free ribbon end will be held securely by the absorbent roll 28. The pivotal arm then swings back into the waiting position, as shown in FIGS. 1 & 11.

Subsequently, the bobbin carrier 14 is (with a clock wise motion) brought out of the position represented in FIG. 10 to the position shown in FIG. 11. In the position illustrated in FIG. 11, the new bobbin lays on the innerside of the material ribbon 22 (which is coming from the running off bobbin), so that both ribbons directly cover each other between the glue station 112 and the circumference of the full bobbin. As the remaining ribbon material runs off the bobbin located at the left in FIG. 11, the ribbon reservoir 98 will be filled in the manner described above. FIG. 12 shows the ribbon reservoir 98 in a partially filled condition.

Now, the unwinding of the ribbon from the unfurling bobbin will be monitored. It should be noticed in time when the end of the ribbon is getting near, so that the ribbon does not rip off the core of the empty bobbin. This is for the purpose, that the ribbon of the unrolled bobbin may be glued to the beginning of the ribbon from the new bobbin, as long as the unrolled ribbon is still held taut. For easy removal of the ribbon remnant from the device, most favorably, one avoids allowing the unrolled ribbon from ripping off of the core of the ribbon spool. For this reason, the sensory mechanism which communicates directly to the ribbon end is eliminated for supervision. The supervisory tasks are thereby solved in the following simple and efficient manner: by means of a sensor 142 (illustrated in FIG. 11), located between the spindle and the nearby ribbon feeding roll 26), the change in the unrolling angle will be measured (resulting from the unrolling ribbon with the spindle 18). As long as the ribbon runs off of the circumference of the bobbin core, it is directed tangently to the core. In the instant the end of the ribbon is coming (this ribbon end being glued to the bobbin core), the last ribbon segment becomes directed radially to the spindle 18, as indicated by the dotted line in FIG. 11. Thus, the ribbon crosses the sensor's 142 sensory path, so that the sensor 142 may produce a signal. This signal abruptly halts the ribbon propulsion, (upstream from the ribbon reservoir 98) by means of manipulating ribbon brake which is not illustrated, or in other words, by means of interrupting the ribbon propulsion. The glue station's 112 impact knife 126, (in conjunction with the opposing knife located across the impact knife 126) directly cuts through both ribbon segments from both bobbins, which lie atop of each other, whereby the ribbon segment, which is still connected to the core of the empty bobbin, is pulled through the relaxed tension roll 30 out of the cut and glue area. By way of a radial adjustment of the glue head 118 in the direction of the bobbin carrier axle 16, the glue strips 124 will be passed onto the ribbon segments, which lay end on end. The segments are thereby connected together, so that only after the release of the ribbon propulsion will the ribbon be pulled from a new full bobbin. During this short interruption, the processing machine is fed ribbon from the full ribbon reservoir 98, so that no interruption in ribbon supply occurs.

Now, as the material ribbon is pulled from the new bobbin, the ribbon remnant which still remains on the empty bobbn core (and which will be intercepted by the catch sheet 144, located under the bobbin carrier 14) must be removed from the device before the bobbin core is removed and a new bobbin can be placed on the empty spindle 18. To do this, the ribbon remnant on the empty bobbin is wound up again by the propulsion of the spindle, so far until it's end runs over the sensor 146 (FIG. 11) in the position of the bobbin carrier 14 represented in FIG. 11. The sensor causes the disconnection of the spindle propulsion. Then the ribbon end is held fast by the absorbent roll 28 which is located across from the sensor 146. The bobbin carrier is subsequently twisted in a clockwise direction from the position depicted in FIG. 11 to the position shown in FIG. 13. In this position (FIG. 13), the band end is received by the absorbent roll 78 (which is connected to the cut off device 50). The cut off device 50 swings over to the bobbin carrier 14, and delivers the ribbon end to the absorbent shaft 46 in the above described manner. The absorbent shaft 46 delivers the ribbon end to the pulling off device 88 in the above described manner. The pulling off device 88 then feeds the ribbon end to the material shredder 90, whereby the ribbon is ripped off of the bobbin core. Subsequently, the empty bobbin core may be removed from the spindle, and a new bobbin may be set in its place, whereupon the above described steps repeat themselves.

We claim:

1. In a device for continuous feeding of a ribbon shaped material to a processing machine, complete with a swingable bobbin-carrier, mounted on bearings to a base frame so as to swivel about a carrier axle, with at least two spindles for the reception of each bobbin, each being situated parallel to the carrier axle at the same radial distance therefrom, a bobbin cutting off station with a cut-off device adjustable to be in operational position either near the carrier axle or to be in a resting position away from the carrier axle, said cut-off device having an adjustable knife, parallel to the carrier axle, capable of cutting through at least one ribbon layer and including a catching device for the free ribbon end, and a glue station to bind the ribbon end of an unrolling bobbin to the beginning end of a new bobbin which is to be unrolled, the improvement wherein the cutting off mechanism (50) as an adjustable splaying finger (62) which is generally parallel to the carrier axle (16) on the outer circumference of the bobbin (20) and adjacent with the knife (68), the splaying finger (62) being insertable as the bobbin (20) rotates under the ribbon near the outer circumference of the bobbin; each spindle (18) on the bobbin carrier (14) being fitted with a ribbon holding device (24) for the free ribbon ends, and the glue station (112) being situated near the circle of rotation (36) of the bobbin carrier (14), the bobbin carrier (14) being rotatable to cause the ribbon holding device (24) to bring a free end of a ribbon of a new bobbin from the cutting station (38) radially under the unrolling ribbon (22) adjacent the glue station (112) where the beginning end of the ribbon of the new bobbin can be connected to the ribbon of the unrolling bobbin.

2. The improvement according to claim 1 wherein a ribbon stretching roll (30) is attached radially on the outside to each spindle (18) on the bobbin carrier 14, which, in view of the unrolling directions of the ribbon (22), lies behind the ribbon holding device (24) which is attached to each spindle (18).

3. The improvement according to claim 1 wherein the knife of the cutting off device (50) includes a rotation knife (68), which at least partially overlaps the splaying finger (62).

4. The improvement according to claim 3 wherein the splay finger (62) and the kife (68) of the cutting off device (50) are situated parallel to the carrier axle (16) on an adjustable sliding carriage (60).

5. The improvement according to claim 4 wherein the cutting off station (38) includes a delivery device (46) to deliver the free ribbon end to a second pulling off device (88) and cutting equipment (80) to cut off the ribbon segment which is pulled off by the second pulling off device (88).

6. The improvement according to claim 5 wherein the cutting equipment (80) has a second knife (82) in relation to the carrier axle (16) that is at least adjustable near the radial, the knife cooperates with a permanently mounted opposition knife (84), located in the area of the ribbon holding device (24).

7. The improvement according to claim 6 wherein the delivery device includes an absorbent element (46), which is situated on an adjustable pivoting arm (40), which is mounted on bearings to a ground frame (10) and is pivotable.

8. The improvement according to claim 7 wherein the absorbent device is fashioned from an absorbent roll (46), which is mounted on bearings to a pivoting arm (40) on an axle parallel to the carrier axle (16); and that the cutting off device (50) and the catching device (78) are situated on an independent oscillating axle (52) which is mounted on bearings and is able to swivel around the roll's axle.

9. The improvement according to claim 8 wherein the second pulling off device (88) activates a disposal mechanism (90) for the ribbon material.

10. The improvement according to claim 9 wherein the catching device and/or the ribbon holding device (24) each include at least one absorbent strip (78)-(28).

11. The improvement according to claim 10 wherein the gluing station (112) has a sticky glue ribbon supply (114, 116), a glue ribbon transfer and pressing element (118), which is radially adjustable in relation to the carrier axle (16), and a third knife (126) to cut through the ribbon segments which lay on top of each other, and are to be joined together, the third knife (126) cooperates with the opposition knife (84) which is connected to the ribbon holding device (24) and wherein the pulling off device (96) has a ribbon reservoir (98) and that downstream from the flow of this reservoir, an optionally operated ribbon brake is situated.

12. The improvement according to claim 11 wherein a sensor (142) responds to a change in the run off angle of the material ribbon (22) as it unrolls from the bobbin, the sensor (142) being equipped with a control mechanism for control of the ribbon propulsion.

13. The improvement according to claim 12 wherein downstream from the ribbon reservoir (98), a sensor mechanism (128) is situated, to determine the condition of the edges of the running off ribbon (22), which is connected with a control mechanism to control the axle placement of the shaft (130) of the bobbin carrier (14).

14. In an apparatus for connecting ribbon shaped material from a new bobbin to a ribbon on an old bobbin, both bobbins being connected to spindles on a carrier which is rotatable about a carrier axle, the apparatus including a cutting off station for cutting through at least one ribbon layer of the new bobbin, with the apparatus additionally including a gluing station for binding the cut ribbon end of the new bobbin to the ribbon of the old bobbin whereby ribbon shaped material can be continuously fed to a processing machine, the improvement wherein the cutting off station includes finger means lying generally parallel to the carrier axle and being insertable under at least one outer layer of the new bobbin and cooperating with a knife to produce a free ribbon end on the new bobbin, holding means connected to the carrier for holding the free ribbon end, means for rotating the carrier about its axle to bring the holding means into underlying relationship with the ribbon being unrolled from the old bobbin adjacent to the gluing station whereby the free end can be connected to the ribbon of the old bobbin.

15. The improvement of claim 14 wherein the cutting station and gluing station are located diametrically opposite the carrier axle and are situated near the circle of rotation of the carrier.

16. The improvement of claim 15 wherein said cutting mechanism includes a pivotable arm including an absorbant device.

* * * * *